US010240609B2

(12) United States Patent
Kobayashi et al.

(10) Patent No.: US 10,240,609 B2
(45) Date of Patent: Mar. 26, 2019

(54) SCREW PUMP AND IMPELLER FAN ASSEMBLIES AND METHOD OF OPERATING

(71) Applicant: GE Aviation Systems LLC, Grand Rapids, MI (US)

(72) Inventors: Sukeyuki Kobayashi, Loves Park, IL (US); Frank Leslie Sincox, III, Rockford, IL (US); Richard George Hext, III, Belvidere, IL (US)

(73) Assignee: GE Aviation Systems LLC, Grand Rapids, MI (US)

( * ) Notice: Subject to any disclaimer, the term of this patent is extended or adjusted under 35 U.S.C. 154(b) by 356 days.

(21) Appl. No.: 14/725,790

(22) Filed: May 29, 2015

(65) Prior Publication Data

US 2016/0348686 A1 Dec. 1, 2016

(51) Int. Cl.
*F04C 2/16* (2006.01)
*F04C 29/02* (2006.01)
(Continued)

(52) U.S. Cl.
CPC ..... *F04D 29/063* (2013.01); *F04C 29/028* (2013.01); *F04D 19/002* (2013.01);
(Continued)

(58) Field of Classification Search
CPC .. F04C 29/023; F04C 29/025; F04C 29/4273; F04C 29/028; F04C 29/12; F04D 29/44; F04D 29/448; F04D 29/548
See application file for complete search history.

(56) References Cited

U.S. PATENT DOCUMENTS 3,648,931 A * 3/1972 Jacobs ..... A47L 15/4221 134/176
3,924,963 A * 12/1975 Zerrer ..... F04D 17/02 415/126
(Continued)

FOREIGN PATENT DOCUMENTS

JP 07317680 A * 12/1995
JP 2002147383 A * 5/2002 ..... F04D 29/4273
(Continued)

OTHER PUBLICATIONS

English translation of JP 07317680 A.*
(Continued)

*Primary Examiner* — Igor Kershteyn
*Assistant Examiner* — Topaz L. Elliott
(74) *Attorney, Agent, or Firm* — GE Aviation Systems LLC; William Andes

(57) ABSTRACT

An impeller fan assembly that includes a housing, a stator, a rotor having a hub and an annular array of non-stationary blades extending from the hub, at least two spaced apart bearings mounted to the stator, and a pump in fluid communication with the bearings to provide fluid to the bearings. A screw pump is provided within the hollow portion of the shaft. Inlet of the screw pump is fluidly coupled to the sump and outlet is in fluid communication with the bearings. Rotation of the screw pump pumps fluid from the sump to the bearings. A de-swirler is provided within the sump to reduce rotational movement of the fluid within the sump. The de-swirler has a hub with fixed curved vanes extending from the centerline of the hub. The curved vanes have curvature in a direction opposite from a rotational direction of the screw pump.

12 Claims, 6 Drawing Sheets

(51) Int. Cl.

| | |
|---|---|
| ***F04D 19/00*** | (2006.01) |
| ***F04D 29/42*** | (2006.01) |
| ***F04D 29/44*** | (2006.01) |
| ***F04D 29/053*** | (2006.01) |
| ***F04D 29/059*** | (2006.01) |
| ***F04D 29/063*** | (2006.01) |

(52) U.S. Cl.
CPC ..... *F04D 29/053* (2013.01); *F04D 29/059* (2013.01); *F04D 29/4273* (2013.01); *F04D 29/448* (2013.01); *F04C 2/16* (2013.01); *F04C 29/025* (2013.01); *F05B 2250/501* (2013.01); *F05D 2250/51* (2013.01)

(56) References Cited

U.S. PATENT DOCUMENTS

| | | | | | |
|---|---|---|---|---|---|
| 4,323,369 | A * | 4/1982 | Monson | B01D 45/12 | 55/385.3 |
| 4,941,317 | A * | 7/1990 | Ivey | F01D 5/085 | 416/95 |
| 5,044,895 | A * | 9/1991 | Frieden | F16N 7/18 | 417/354 |
| 5,320,482 | A * | 6/1994 | Palmer | F04D 29/0416 | 415/104 |
| 5,372,490 | A * | 12/1994 | Fain | F04C 18/0215 | 184/6.18 |
| 5,947,892 | A * | 9/1999 | Benkowski | A61M 1/10 | 415/900 |
| 5,957,672 | A * | 9/1999 | Aber | A61M 1/10 | 384/907.1 |
| 6,039,551 | A * | 3/2000 | Takeuchi | F04C 2/086 | 184/6.16 |
| 6,533,543 | B2 * | 3/2003 | Tagomori | F04D 29/4273 | 415/151 |
| 7,168,926 | B2 | 1/2007 | Manda et al. | | |
| 8,007,565 | B2 * | 8/2011 | Moredock | B01D 45/16 | 55/396 |
| 9,217,436 | B2 * | 12/2015 | Kobayashi | F04D 3/02 | |
| 2013/0022508 | A1 * | 1/2013 | Leboeuf | B01J 19/006 | 422/132 |
| 2014/0044524 | A1 | 2/2014 | Kobayashi et al. | | |

FOREIGN PATENT DOCUMENTS

| | | | | |
|---|---|---|---|---|
| JP | 2005069048 | A * | 3/2005 | |
| JP | 2009222003 | A * | 10/2009 | F04D 29/4273 |
| JP | 2010190184 | A * | 9/2010 | |
| KR | 20130073026 | A * | 7/2013 | F04D 29/4273 |

OTHER PUBLICATIONS

English translation of JP 2002147383 A.*
English translation of JP 2010190184 A.*
English translation of KR 20130073026 A.*
English translation of JP 2005069048.*
English translation of JP 2009222003.*

* cited by examiner

SCREW PUMP AND IMPELLER FAN ASSEMBLIES AND METHOD OF OPERATING

BACKGROUND OF THE INVENTION

Contemporary aircraft include fans used for various cooling purposes, which currently include a configuration having two grease-packed bearings that support a rotating shaft of the fan. Due to a harsh operational environment of high temperature and high rotational speeds, the grease forming the bearing lubricant deteriorates quickly, resulting in relatively frequent maintenance to keep the fan in operating condition. The maintenance is currently done by completely removing at least a portion of the fan from the aircraft, which is expensive and time consuming.

In U.S. Patent Application Publication No. 2014/0044524 a fan that utilizes oil for shaft bearing lubrication instead of grease is described. The integrated screw pump within the shaft circulates oil in a vertical orientation for bearing lubrication and allows the fluid to be changed without removing the impeller fan assembly from the aircraft. The casing of the pump allows for swirling of the lubrication fluid, which can prevent the pump from achieving maximum effectiveness. Using a separate lubricating pump and plumbing system could complicate the fan mechanism and increase cost.

BRIEF DESCRIPTION OF THE INVENTION

In one embodiment, the invention relates to an impeller fan assembly including a housing having an inner peripheral wall defining a flow through passage, a stator located within the flow through passage and including an annular array of stationary blades provided along the inner peripheral wall, a rotor having a hub and an annular array of non-stationary blades extending from the hub, at least two spaced apart bearings mounted to the stator, a shaft having a hollow portion rotatably supported by the bearings for rotation about a rotational axis, a sump provided in the stator, a screw pump provided within the hollow portion of the shaft and having a screw pump inlet fluidly coupled to the sump and a screw pump outlet in fluid communication with the bearings, whereby rotation of the screw pump pumps fluid from the sump to the bearings and a de-swirler located within the sump and configured to reduce rotational movement of the fluid within the sump.

In another embodiment, the invention relates to a screw pump assembly having a sump, a shaft having a hollow portion and a screw pump rotatable about a rotational axis and provided within the hollow portion of the shaft and having a screw pump inlet fluidly coupled to the sump and a screw pump outlet, whereby rotation of the screw pump pumps fluid from the sump to the screw pump outlet, and a de-swirler having a set of vanes and located within the sump and configured to reduce rotational movement of the fluid within the sump.

In yet another embodiment, the invention relates to a method of rotating a screw pump assembly that includes rotating the screw pump to create a flow of liquid entering into the hollow portion and moving the liquid through the hollow portion to the screw pump outlet and imparting a force to the liquid entering the hollow portion to counter at least some rotational motion of the entering liquid.

DESCRIPTION OF EMBODIMENTS OF THE INVENTION

Figure 1:
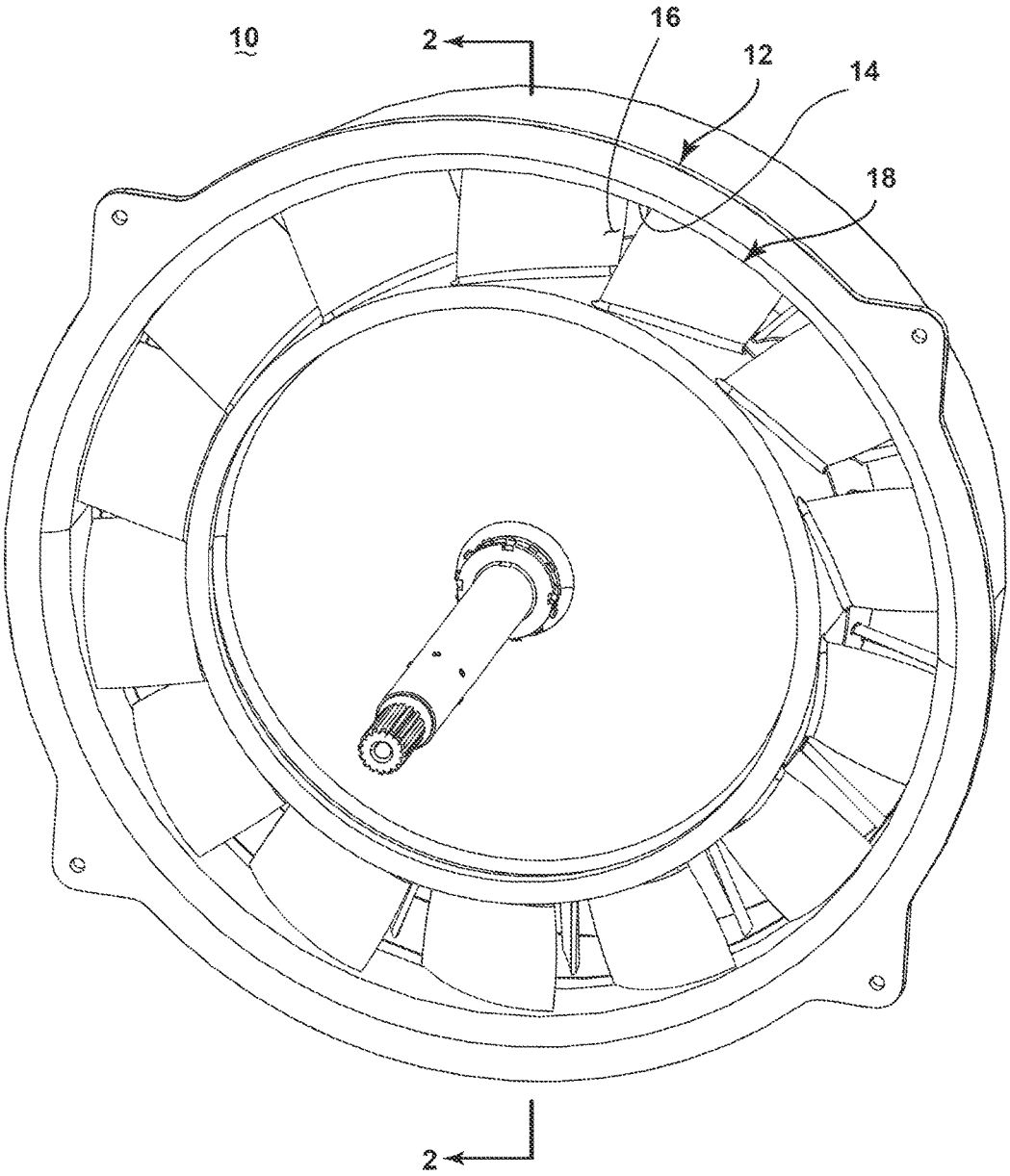
FIG. 1 is a front view of an impeller fan assembly according to an embodiment of the invention.

FIG. 1 illustrates a front view of an impeller fan assembly 10 according to an embodiment of the invention. The impeller fan assembly 10 can be a cooling fan for an aircraft engine or other aircraft application. The impeller fan assembly 10 can be oriented in either a horizontal or vertical orientation, including any angular position between horizontal and vertical. In some applications, the fan assembly 10 can be mounted to the aircraft such that the impeller fan assembly 10 rotates between horizontal and vertical orientations.

A housing 12 including an inner peripheral wall 14 defining a flow through passage 16 can be included in the impeller fan assembly 10. In the illustrated example, the flow of air is left to right through the flow through passage 16. An impeller 18 can be moveably mounted within the housing 12 and a cooling air stream can be generated by the impeller 18 during operation of the impeller fan assembly 10.

Figure 2:
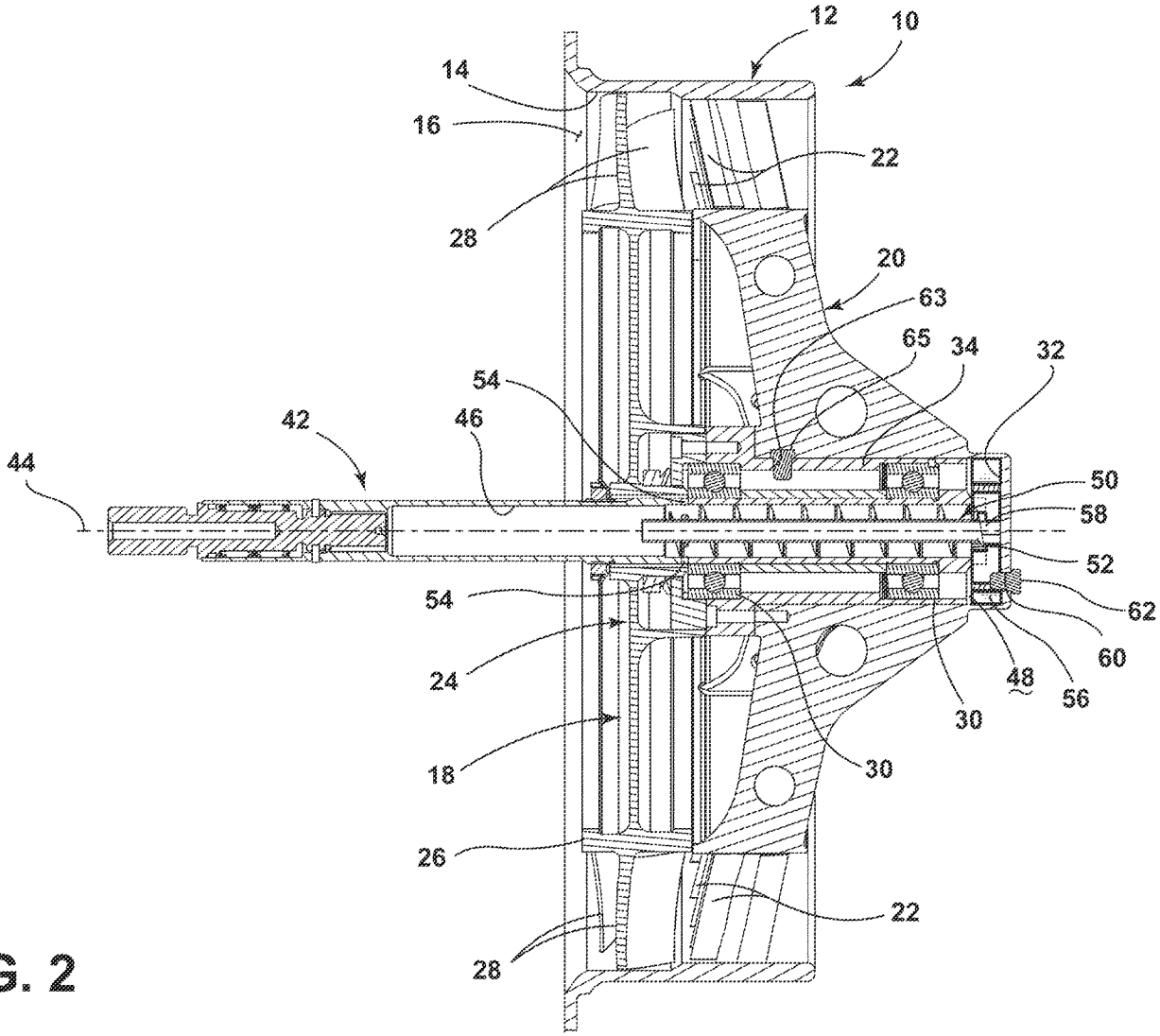
FIG. 2 is a cross-sectional view of the impeller fan assembly of FIG. 1 and more clearly illustrates a de-swirler according to an embodiment of the invention.

FIG. 2 illustrates a partial cross-sectional view of a portion of the impeller fan assembly 10 taken along the line 2-2 (shown in FIG. 1). A stator 20 can be located within the flow through passage 16 and can include an annular array of stationary blades 22 provided along the inner peripheral wall 14. It is also contemplated that the stator 20 can form a portion of the housing 12. A rotor 24 is also illustrated and includes a hub 26 and an annular array of non-stationary blades 28 extending from the hub 26. Both the stator 20 and rotor 24 form portions of the impeller 18.

A set of spaced apart bearings 30 can be operably mounted to the stator 20. More specifically, the stator 20 has been illustrated as including a recess 32 and a bearing housing 34 has been illustrated as mounting the bearings 30. The bearing housing 34 can be received within the recess 32 of the stator 20. By way of non-limiting example, two spaced apart bearings 30 have been shown; however, it will be understood that set of spaced apart bearings 30 can include additional bearings.

A shaft 42 can be rotatably supported by the bearings 30 for rotation about a rotational axis 44. The rotor 24 can be operably coupled to the shaft 42 such that both the shaft 42 and rotor 24 can be co-rotated. The shaft 42 can include a hollow portion 46.

A sump 48 can also be provided in the stator 20. In the illustrated example, the bearing housing 34 and a portion of the recess 32 of the stator 20 define the sump 48. A fluid, including but not limited to, oil can be introduced into the sump 48. The sump 48 can span the spaced apart bearings 30 such that when the shaft 42 is oriented such that the rotational axis 44 is horizontal, the bearings 30 are at least partially immersed within the fluid in the sump 48.

Conversely, when the shaft 42 is oriented such that the rotational axis 44 is vertical, one or more of the bearings 30 can be located such that it is not immersed in the fluid within the sump 48. A screw pump 50 is included to circulate the fluid and lubricate the bearings 30 in such an orientation. The screw pump 50 has been illustrated as being provided within the hollow portion 46 of the shaft 42. The screw pump 50 can be coupled to the shaft 42 such that the screw pump 50 co-rotates with the shaft 42. For example, the screw pump 50 can be securely attached to the hollow portion 46 of the shaft 42 such that it rotates together with the shaft 42.

A screw pump inlet 52 of the screw pump 50 fluidly couples to the sump 48. The screw pump inlet 52 can be located such that when the rotational axis is horizontal, the screw pump inlet 52 is not immersed in the fluid in the sump 48. The screw pump inlet 52 can be located such that when the rotational axis is vertical, the screw pump inlet 52 is immersed in the fluid in the sump 48. In the illustrated example, the bottom of the shaft 42 is open as an inlet and the screw pump 50 extends slightly beyond it, to enhance scooping action of the fluid within the sump 48.

A screw pump outlet 54 can also be in fluid communication with the bearings 30. Several screw pump outlets 54 have been illustrated in the exemplary embodiment. The screw pump outlet 54 can be located such that when the rotational axis 44 is vertical, fluid emitted from the screw pump outlet 54 flows by gravity onto at least one of the bearings 30. In the illustrated example, the screw pump outlet 54 is located above the spaced apart bearings 30 such that when the rotational axis 44 is vertical, fluid emitted from the screw pump outlet 54 flows by gravity onto both of the bearings 30.

A de-swirler 56 can be included within the sump 48 near the screw pump inlet 52. The de-swirler 56 can be operably coupled to the bearing housing 34 or, as illustrated, a portion of the recess 32 of the stator 20. By way of non-limiting example, the de-swirler 56 can be interference fit within the recess 32 of the stator 20. While the de-swirler 56 is shown as a stationary structure it could alternatively be moveable or rotatable. It is contemplated that the de-swirler 56 can be formed from any suitable material including, by way of non-limiting example, plastic to allow it to be flexible enough to be placed within the recess 32 of the stator 20. Further, a spacer 58 can be included between the screw pump 50 or bearing housing 34 to fix a depth between the pump inlet 52 and the de-swirler 56.

A fluid access port 60 can be formed in the stator 20 and fluidly coupled to the sump 48. The fluid in the sump 48 can be drained through the fluid access port 60. A plug 62 can be used to close the fluid accesses port 60. Any suitable plug 62 can be used. Further, a second access port 63 can be formed in the bearing housing 34 and fluidly coupled to the sump 48. Fluid can be filled in the sump 48 through the second access port 63. A plug 65 can be included to close the second access port 63.

Figure 3:
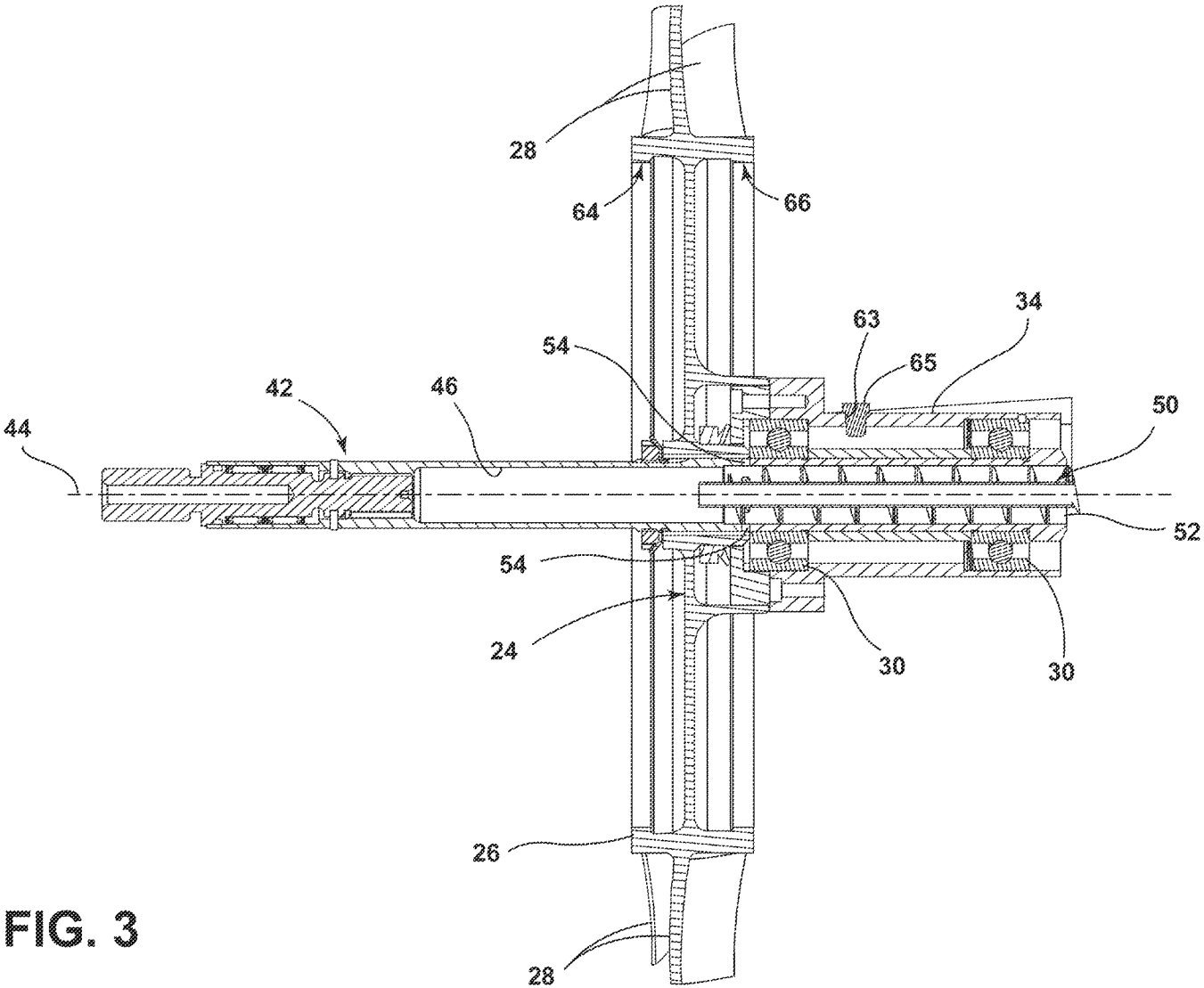
FIG. 3 is a cross-sectional view of portions of the impeller fan assembly of FIG. 2.

As more clearly illustrated in FIG. 3, the shaft 42 can be coupled to the bearing housing 34 such that shaft 42, screw pump 50, bearings 30, and bearing housing 34 form a cartridge that can be connected to the stator 20 and the rotor 24. The cartridge has been illustrated as being attached to the rotor 24. The cartridge can be integrated into the impeller fan assembly 10 without causing a weight increase as compared to contemporary configurations. The cartridge makes it possible to balance the sub-assembly at this stage utilizing a front balance plane 64 and a rear balance plane 66. Balance adjustment is performed prior to final assembly, due to inaccessibility to the rear balance plane 66 once the cartridge is mounted to the stator 20.

Figure 4:
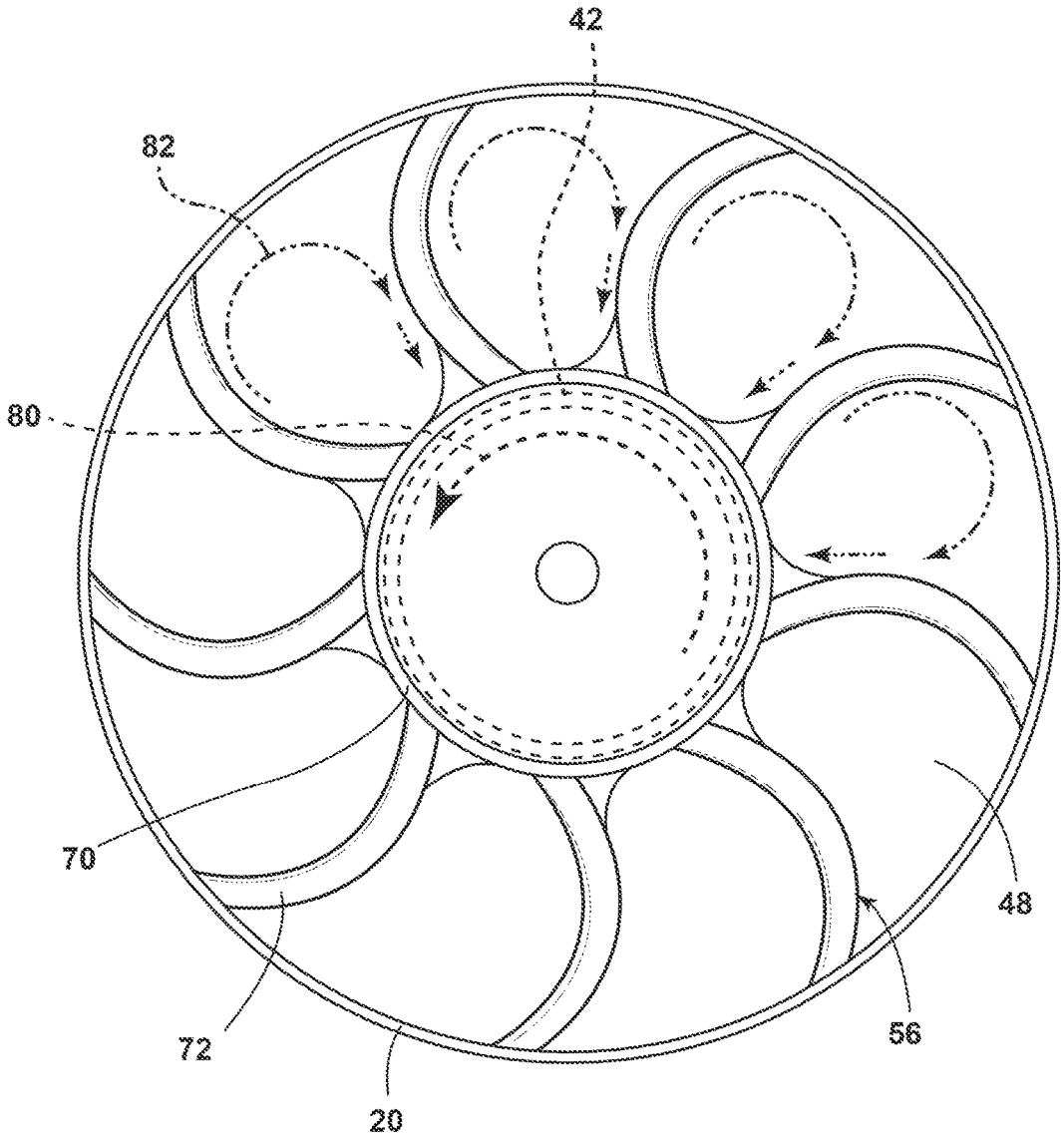
FIG. 4 is a schematic top view of a de-swirler and housing of the impeller fan assembly of FIG. 2.

FIG. 4 illustrates a top view of an exemplary de-swirler 56 located within the sump 48. The exemplary de-swirler 56 includes a hub 70 with a set of fixed vanes 72 or vertical fences that extend from the hub 70. By way of non-limiting example, the vanes 72 have been illustrated as being curved relative to a centerline of the hub 70. The curved vanes 72 include curvature in a direction opposite from a rotational direction of the screw pump 50, which is illustrated with directional arrow 80. It will be understood that the de-swirler 56 can be formed, shaped, or in virtually any suitable manner such that it reduces rotational movement of the fluid within the sump 48 as compared to movement of the fluid within the sump 48 in an absence of the de-swirler. In this manner it will be understood that the de-swirler 56 can be any suitable structure or mechanism for countering or impeding a rotational movement of the fluid through the sump 48. This can include that any number of vanes that are oriented in any suitable manner can be included and that the de-swirler can be integrally formed or formed from a number of separate pieces. For illustrative purposes flow patterns created by the de-swirler 56 are illustrated schematically at 82. Without the inclusion of a de-swirler the flow pattern could be one that includes rotational movement completely around the shaft 42.

Figure 5:
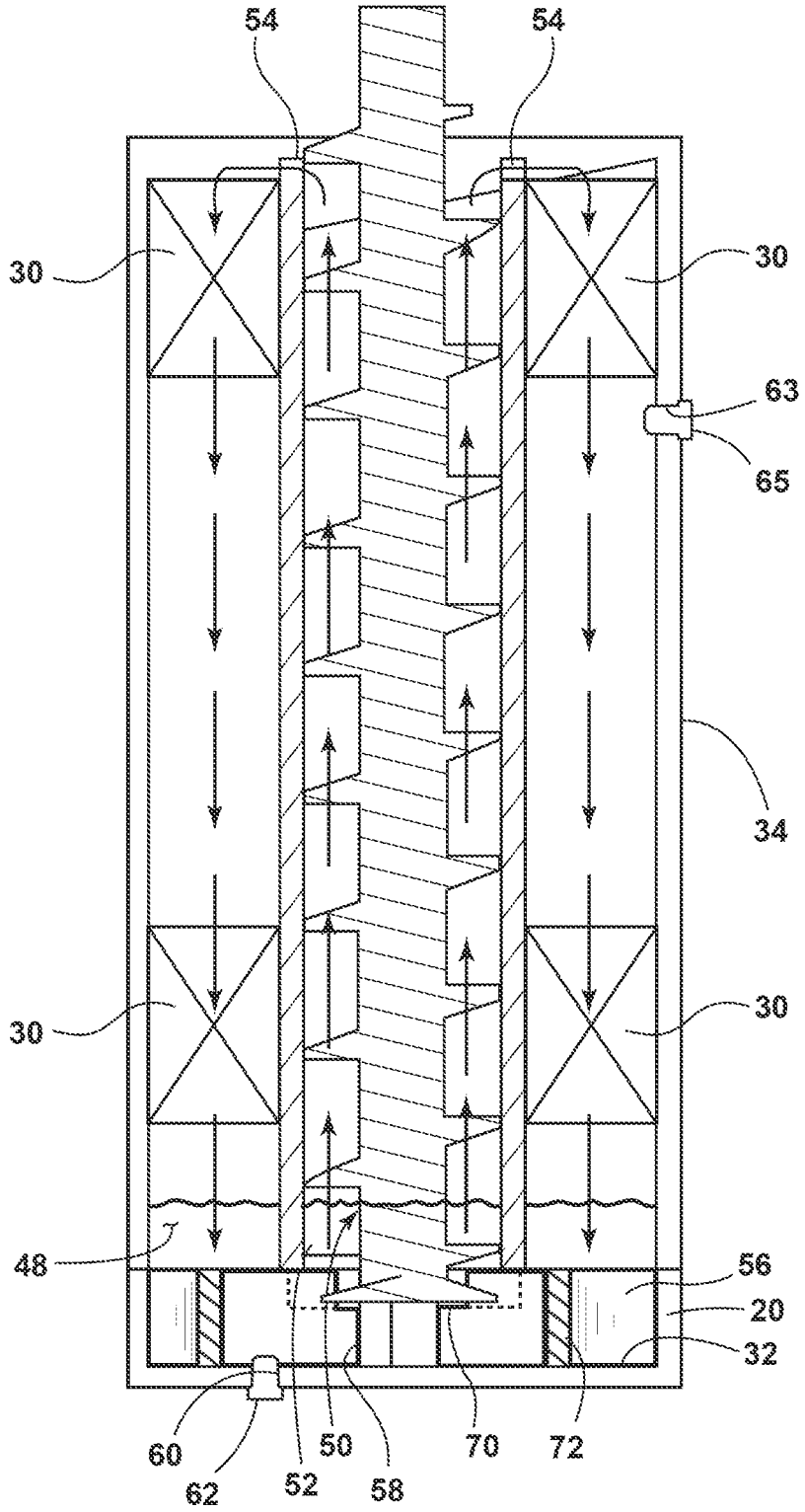
FIG. 5 is a cross-sectional view illustrating fluid movement when the impeller fan assembly of FIG. 1 is in a vertical orientation according to an embodiment of the invention.

During operation, rotation of the shaft 42 is utilized to operate the screw pump 50 (shown in FIGS. 2 and 3). A quantity of fluid in the sump 48 can be adjusted for both horizontal and vertical orientations of the impeller fan assembly 10. Referring to FIG. 5, when the shaft 42 is in the vertical orientation, the screw pump inlet 52 is immersed in the fluid in the sump 48 and the screw pump 50 pumps fluid from the sump 48 through the hollow portion 46 and through the screw pump outlets 54 to the bearings 30. More specifically, by its rotational motion, the screw pump 50 scoops fluid from the sump 48 and pushes it up along its spiral slope. Once the fluid reaches the top of the screw pump it is dispersed radially through the screw pump outlet 54 where it flows by gravity onto the bearings 30 and in this manner fluid circulates and lubricates both bearings 30. Gravity pulls the fluid downward and the fluid collects in the sump 48 where it can be recirculated.

The rotation of the shaft 42 and the screw pump 50 can create rotational motion of the fluid within the sump 48. The de-swirler 56 imparts a force to the liquid in the sump 48 and entering the hollow portion 46 of the shaft 42 to counter at least some rotational motion of the entering liquid. The reduction of the rotational movement of the fluid within the sump 48 caused by the de-swirler 56 increases the effectiveness of pump 50 and its scooping action.

Figure 6:
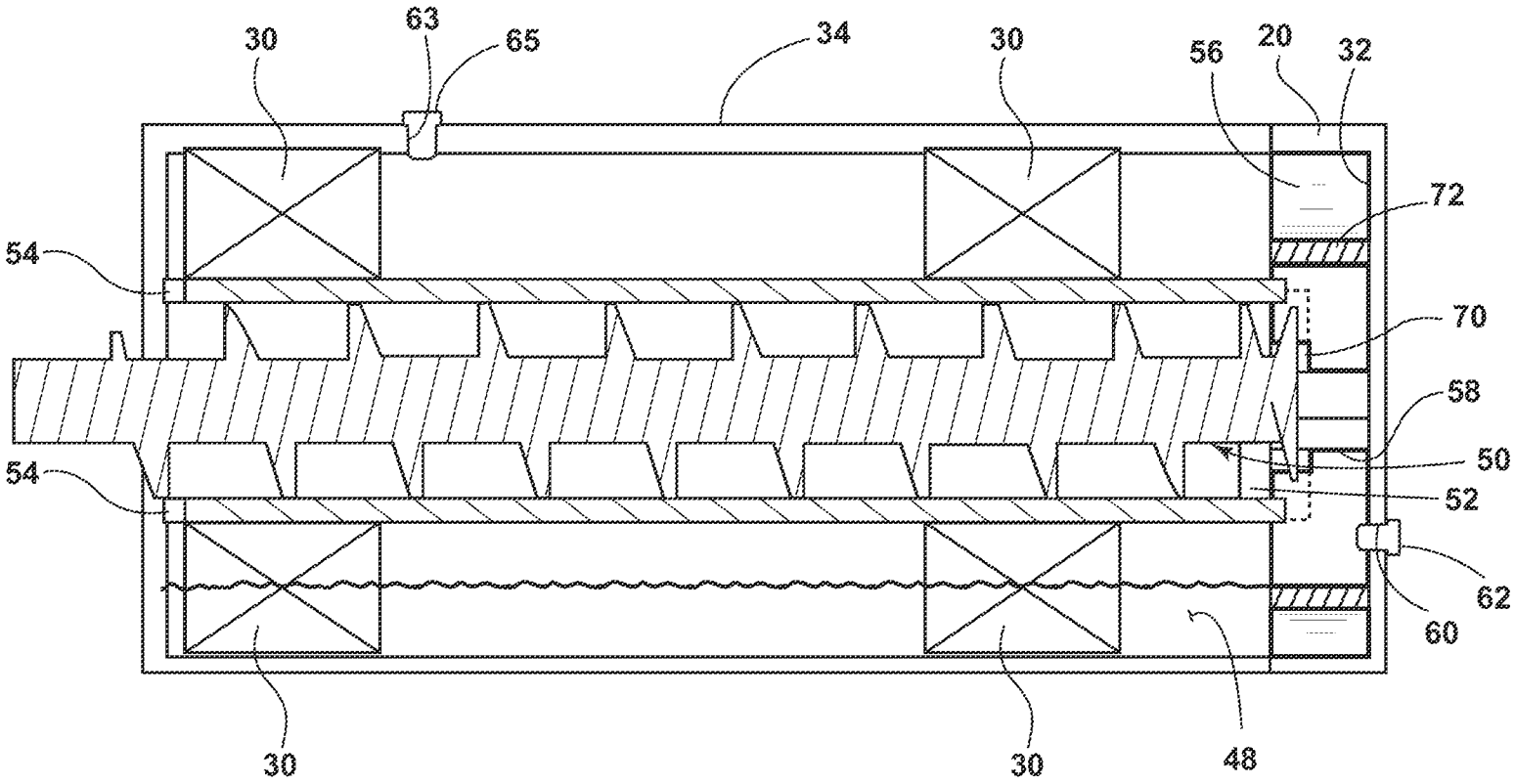
FIG. 6 is a cross-sectional view illustrating bearings partially immersed in fluid when the impeller fan assembly of FIG. 1 is in a horizontal orientation according to an embodiment of the invention.

Referring to FIG. 6, when the shaft 42 is in the horizontal orientation, the bottom part of both bearings 30 is submerged in the fluid located in the sump 48. Rotation of the shaft 42 results in motion of the bearings 30 and evenly wets the bearings 30. In the horizontal orientation, the screw pump 50 is not needed and stays above the fluid pooled in the sump 48. This also results in the impeller fan assembly 10 avoiding unnecessary increase in shaft torque, which would in turn cause increased power consumption.

The embodiments described above provide for a variety of benefits including that they have higher efficiency, high reliability, less maintenance, all-attitude operation, and lower weight. The embodiments described above use a fluid such as oil, in place of grease, for bearing lubrication, and allow the fluid to be changed without removing the impeller fan assembly from the aircraft. This results in a reduced frequency of the removal of the impeller fan assembly and greatly prolongs the service life of the impeller fan assembly, which will result in cost savings, as well as much improved aircraft utilization. The embodiments described above result in easier maintenance and improved fan service life, which results in commercial advantages including reduced maintenance cost and reduced down time of the aircraft on which the impeller fan assembly is installed. Further, the above-described embodiments increase effectiveness of the pump including its scooping action.

This written description uses examples to disclose the invention, including the best mode, and also to enable any person skilled in the art to practice the invention, including making and using any devices or systems and performing any incorporated methods. The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An impeller fan assembly comprising:

a housing having an inner peripheral wall defining a flow through passage;

a stator located within the flow through passage and having an annular array of stationary blades provided along the inner peripheral wall;

a rotor having a hub and an annular array of non-stationary blades extending from the hub;

at least two spaced apart bearings mounted to the stator;

a shaft having a hollow portion rotatably supported by the bearings for rotation about a rotational axis;

a sump provided in the stator;

a screw pump provided within the hollow portion of the shaft and having a screw pump inlet fluidly coupled to the sump and a screw pump outlet in fluid communication with the bearings, whereby rotation of the screw pump about a screw pump rotational axis pumps fluid from the sump to the bearings; and a de-swirler located within the sump and configured to reduce rotational movement of the fluid within the sump as compared to movement of the fluid within the sump in an absence of the de-swirler;

wherein the de-swirler includes a deswirler hub having a centerline coaxial with the rotational axis and having fixed vanes extending radially from the deswirler hub, the vanes being curved relative to the centerline of the deswirler hub and wherein the curved vanes include curvature in a direction opposite from a rotational direction of the screw pump to redirect fluid toward the centerline.

2. The impeller fan assembly of claim 1 wherein the sump spans the bearings such that when the shaft is oriented such that the rotational axis is horizontal, the bearings are at least partially immersed within the fluid in the sump, and when the shaft is oriented such that the rotational axis is vertical, at least one of the bearings is not immersed in the fluid within the sump.

3. The impeller fan assembly of claim 2 wherein the screw pump inlet is located such that when the rotational axis is horizontal, the screw pump inlet is not immersed in the fluid in the sump.

4. The impeller fan assembly of claim 3 wherein the screw pump inlet is located such that when the rotational axis is vertical, the screw pump inlet is immersed in the fluid in the sump.

5. The impeller fan assembly of claim 4 wherein the screw pump outlet is located such that when the rotational axis is vertical, fluid emitted from the screw pump outlet flows by gravity onto at least one of the bearings.

6. The impeller fan assembly of claim 1 wherein the screw pump is coupled to the shaft such that the screw pump co-rotates with the shaft.

7. The impeller fan assembly of claim 1, further comprising a bearing housing mounting the bearings, and the stator includes a recess in which the bearing housing is received.

8. The impeller fan assembly of claim 7 wherein the bearing housing and the recess define the sump.

9. The impeller fan assembly of claim 7 wherein the de-swirler is operably coupled to the bearing housing or the recess of the stator.

10. The impeller fan assembly of claim 9 wherein the de-swirler is interference fit with the bearing housing or the recess of the stator.

11. A screw pump assembly, comprising:

a sump;

a shaft having a hollow portion; and a screw pump rotatable about a rotational axis and provided within the hollow portion of the shaft and having a screw pump inlet fluidly coupled to the sump and a screw pump outlet, whereby rotation of the screw pump pumps fluid from the sump to the screw pump outlet; and a de-swirler having a set of vanes and located within the sump and configured to reduce rotational movement of fluid within the sump as compared to movement of the fluid within the sump in an absence of the de-swirler;

wherein the de-swirler includes a hub with fixed vanes extending from the hub, the vanes being curved relative to a centerline of the hub and wherein the curved vanes are configured to include curvature in a direction opposite from a rotational direction of the screw pump to redirect fluid flow toward the centerline.

12. A method of operating a screw pump assembly having a sump containing liquid, a shaft having a hollow portion, a screw pump rotatable about a rotational axis and provided within the hollow portion of the shaft and having a screw pump inlet fluidly coupled to the sump and a screw pump outlet, a de-swirler having a set of vanes and located within the sump and configured to reduce rotational movement of fluid within the sump, the de-swirler including a hub with fixed vanes extending from the hub, the set of vanes being curved relative to a centerline of the hub and the set of curved vanes including curvature in a direction opposite from a rotational direction of the screw pump, the method comprising:

rotating the screw pump to create a flow of liquid entering into the hollow portion and moving the liquid through the hollow portion to the screw pump outlet; and imparting a force to the liquid entering the hollow portion to counter at least some rotational motion of the liquid entering the hollow portion, wherein imparting the force redirects the liquid radially inward toward the centerline of the hub.

* * * * *